United States Patent [19]

McGlew et al.

[11] Patent Number: 4,898,112

[45] Date of Patent: Feb. 6, 1990

[54] CARGO SHIP HAVING STOWAGE SPACE FOR FLOATABLE SELF-PROPELLED WAREHOUSES

[76] Inventors: John J. McGlew; John J. McGlew, Jr., both of P.O. Box 823, Tuxedo Park, N.Y. 10987

[21] Appl. No.: 770,357

[22] Filed: Aug. 27, 1985

Related U.S. Application Data

[63] Continuation of Ser. No. 400,938, Jul. 22, 1982, abandoned, which is a continuation of Ser. No. 896,050, Apr. 13, 1978, abandoned.

[51] Int. Cl.[4] ..... B63B 35/42

[52] U.S. Cl. ..... 114/255; 114/260; 414/137.7; 414/137.9; 414/138.7; 414/139.4

[58] Field of Search ..... 414/137–139, 414/137.1, 137.7, 137.9, 138.7, 139.4; 280/43.16, 638; 440/90; 114/72, 75, 60, 26, 259, 260

[56] References Cited

U.S. PATENT DOCUMENTS

| | | | |
|---|---|---|---|
| 1,856,611 | 5/1932 | Woodruff | 114/72 |
| 2,357,084 | 8/1944 | Cleofe | 440/90 |
| 2,406,084 | 8/1946 | Levin | 114/260 |
| 2,963,310 | 12/1960 | Abolins | 114/72 |
| 3,168,955 | 2/1965 | Black | 414/138 |
| 3,318,276 | 5/1967 | Nemec | 114/260 |
| 3,380,422 | 4/1968 | Bachko | 114/72 |
| 3,556,036 | 1/1971 | Walls | 114/72 |

FOREIGN PATENT DOCUMENTS

| | | | |
|---|---|---|---|
| 1458161 | 11/1966 | France | 114/270 |

*Primary Examiner*—Sherman D. Basinger
*Attorney, Agent, or Firm*—McGlew & Tuttle

[57] ABSTRACT

A cargo ship construction comprises a ship which has a hull structure with at least one cargo storage space opening to at least one side both above and below the water line. A cargo storage container or warehouse of substantially the size of the cargo storage space of the vessel is insertable through the opening into the space. The container is associated with a flotation arrangement such as a separate propelled vehicle which may operate on either land or water and which is provided with a lifting section for lifting cargo storage container into the section. The device may travel on land and then float out to sea and load the cargo onto the vessel either by floating it in when the vessel is ballasted so that the opening is below the water line or the device may raise the cargo above the water level and permit it to slide into the receiving space of the vessel. The cargo storage container itself advantageously includes a sea water drive for propelling it through the sea water and for floating it upwardly and downwardly in the sea water at a selected ballasting. The cargo storage container itself may be propelled on land and sea and, for this purpose, it advantageously includes extendable and retractable legs containing wheel travelling elements or sea propelling elements.

9 Claims, 2 Drawing Sheets

CARGO SHIP HAVING STOWAGE SPACE FOR FLOATABLE SELF-PROPELLED WAREHOUSES

This is a continuation of Ser. No. 400,938 filed July 22, 1982, which is a continuation of Ser. No. 896,050 filed Apr. 13, 1978, both of which are now abandoned.

DESCRIPTION OF THE PRIOR ART

There are many instances in which a sea-going vessel cannot enter into a harbor in which there are unloading facilities for unloading cargo containers or other cargo from the vessel. In the case of wartime, amphibious vessels which are used to transport tanks and other military equipment to beachheads, have heretofore been constructed so that they must enter upon the beach and permit their cargo to move off on its own propulsion over the front loading ramp to dry land. The difficulty in such arrangement is that the vessel must wait for the tides for landing and retracting from the beach head and the loading and unloading practice may sometimes have to be undertaken in a dangerous military area which is subject to fire. At the present time, such military vessels are in the stage of being replaced by vessels in which military cargo containers are airlifted by helicopter from a vessel anchored offshore to a landing spot on the shore. The loading and unloading of the cargo by helicopter, however, is not an easy undertaking and requires a large number of helicopters as well as supporting crew for effecting the unloading and loading.

SUMMARY OF THE INVENTION

In accordance with the present invention, there is provided a cargo ship which includes one or more cargo storage spaces which are accessible through openings which extend to either or both sides of the vessel. Associated with the vessel are removable cargo storage containers or warehouses which may be propelled under their own power over land or sea and either floated into position through the cargo loading opening or positioned so that they may be slid into the opening upon suitably formed rollers of the vessel or the cargo storage container.

In one embodiment of the invention, the cargo storage container comprises a warehouse which is stationed ashore and which may be regularly loaded with equipment such as by a truck loading ramp and then the container is closed. The container may be designed so that it will be picked up by a loading and unloading device which comprises a floatable member having wheels for propelling it over land and a suitable marine propulsion for propelling it through the sea. The cargo storage container itself is advantageously made floatable so that it may be floated off the handling vessel onto the cargo ship. Preferably, the cargo storage container itself is made with a flotation section which may be ballasted and unballasted and contains its own marine as well as land propulsion means so that after loading, it may be driven along the shore and then down into the sea and moved out to the sea at the location of loading of the vessel. At such loading location, the cargo storage container may be lifted into position and then slid into the opening of the vessel, or the vessel may be ballasted so that the opening is located below or partially below the water level and the cargo storage container may be either pushed or moved into the cargo storage space by its own propulsion.

In one embodiment of the invention, the cargo storage container includes a plurality of supporting legs, with one or more of the legs carrying marine or land propulsion means such as wheels or panels. The legs are mounted advantageously in tubular elements so that they may be retracted upwardly completely into the cargo storage container. When the container is loaded, the legs may be extended and they may advantageously include wheels which run over the ground under the drive of a propulsion element carried by the container up to the shore line. The legs may remain extended and the device run down into the sea. In addition, the legs may be extended to a position in which the legs will ride on the bottom of the sea and hold the cargo element at the water level or above the water level. To avert the possibility of encountering mines or similar obstacles, the legs may be made so that they may be extended laterally so that the support of the cargo is at a location far to each side thereof or the cargo container may be elevated above the sea level so that explosions of mines would have a minimum effect. Alternatively, the legs may be completely retracted and the cargo storage container floated by itself and driven by a separate propulsion element out to the loading vessel.

For loading onto the vessel, the cargo storage container may be floated into a well having the opening for receiving the cargo when the receiving vessel is ballasted so that the water level is sufficiently high in such locations. After insertion of the cargo container into a position in which it advantageously extends from one side of the ship to the other and closes the well, the vessel may be regulated to the ballasting best suitable for travelling over the sea. Unloading may proceed in a similar manner in which the individual elements are either pushed or driven by their own propulsion out of the receiving well and moved off the vessel directly onto the shore.

To facilitate traveling in a device of this nature in military operations, the individual cargo containers are equipped with both a navigational station as well as a station for operating all of the various supporting legs and other structures. Alternatively, the individual units may be automatically controlled from the operating vessel by suitable automatic control mechanisms or radio devices.

Accordingly, it is an object of the invention to provide an improved cargo ship construction in which the ship includes cargo storage space which is accessible through an opening in the side of the ship and wherein the space is fillable by a cargo storage container which may be floated or lifted into and off the vessel through the side loading spaces and which is advantageously associated with flotation means to bring it onto a receiving beach or loading area.

A further object of the invention is to provide a device for handling floatable cargo storage containers so that they may be loaded at a separate warehouse station on land and then positioned on a carrying element for driving it directly into the sea and for floating it out on the sea to the vessel.

A further object of the invention is to provide a cargo storage container which includes means for floating it on the sea and for supporting it for travel over land and for propelling it on the sea and which is adapted to be engaged on a vessel by flotation or sliding engagement into a receiving dock thereof for final transport over large sea areas.

A further object of the invention is to provide a cargo ship construction and a cargo storage container which are simple in design, rugged in construction and economical to manufacture.

A further object of the invention is to provide a method of handling cargo for transportion over seas and for landing facilities which do not include unloading areas which comprises loading the cargo to be shipped into a cargo loading container at a warehouse station, closing the warehouse station and moving it along land and into the sea, floating the warehouse cargo storage container and moving it out to a loading vessel, directing the cargo storage container onto the loading vessel when the vessel is ballasted to facilitate the movement of the cargo storage container thereon into a receiving loading space, readjusting the ballasting of the vessel after loading and moving the vessel off in the sea with the loaded cargo storage container for subsequent unloading in a similar manner.

A further object of the invention is to provide a cargo ship construction and a cargo storage container which is simple in design, rugged in construction and economical to manufacture.

While specific embodiments of the invention have been shown and described in detail to illustrate the application of the principles of the invention, it will be understood that the invention may be embodied otherwise without departing from such principles.

GENERAL DESCRIPTION OF THE PREFERRED EMBODIMENTS

Figure 1:
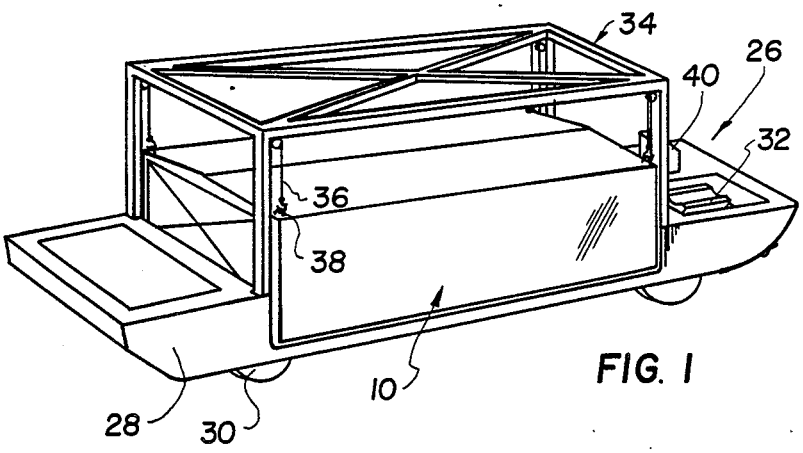
FIG. 1 is a schematic perspective view of a cargo storage container handling device with a cargo storage container constructed in accordance with the invention.
Figure 2:
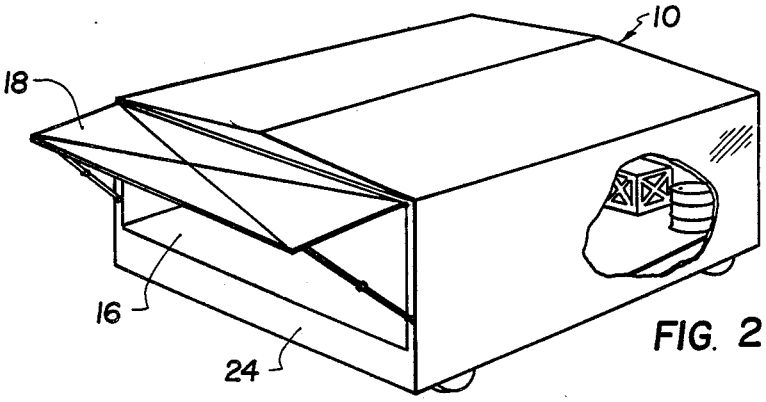
FIG. 2 is a view of this cargo storage container shown in FIG. 1.
Figure 3:
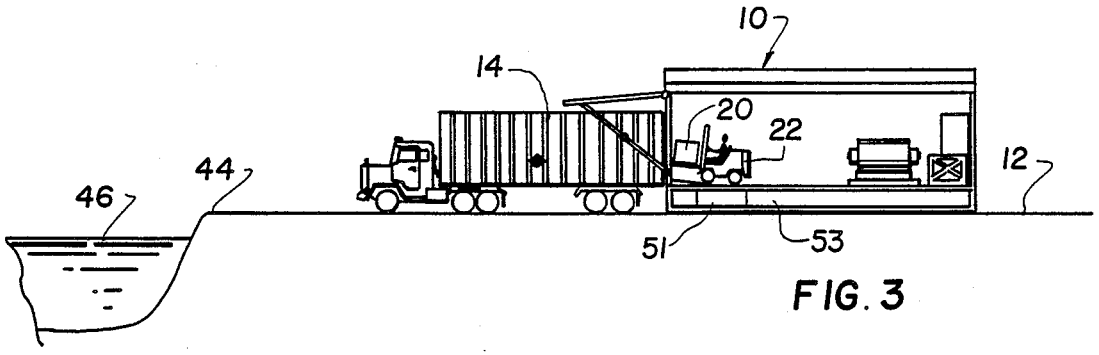
FIG. 3 is a side elevational view, partly in section, showing the use of the cargo storage container as a warehouse.

Referring to the drawings in particular, the invention embodied therein in FIG. 1 comprises the cargo storage container or warehouse generally designated 10 which, as shown in FIGS. 2 and 3, is adapted to be positioned at a warehouse station 12 and fully loaded for whatever period it takes. In the schematic view of FIG. 3, a truck 14 is shown in a position at the warehouse station 12 at which it is backed into an open front end 16 of the cargo storage container 10. This front end 16 is closed in the embodiment illustrated by a front closing door or flap 18 which, when shut, will seal the inside of the container. All sorts of cargo may be loaded into the warehouse cargo storage container 10 including individual containers themselves as well as bulk material 20 which is shown being handled by a fork lift truck 22.

In the embodiment shown, the container 10 advantageously includes a lower section 24 which may be ballasted or unballated for regulating the flotation of the container, if necessary. The cargo storage container 10 is also adapted to be equipped with marine propulsion means (not shown) and land propulsion means (not shown). In the embodiment of FIGS. 1 to 3, the cargo storage container 10 may be associated with the marine and land propulsion means in the form of a separate device generally designated 26. This separate device 26 comprises a flotation hull 28 having wheels 30 for moving it over the ground on land and having a propulsion unit 32 for propelling it through the sea. In addition, it has a central crane or lifting section generally designated 34 which includes lifting cables 36 which may be secured to lifting eyelets 38 of the cargo storage container 10 and which may be controlled through a control console 40. The cables 36 and the eyelets 38 are spaced around the container 10 so that the container may be either dragged laterally or lifted vertically to position it in the loading space 34.

Figure 5:
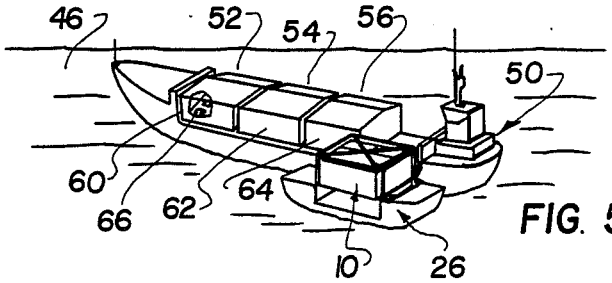
FIG. 5 is a view of a vessel showing a cargo storage container being transported to the vessel on a transporting device for insertion into a cargo receiving space of the vessel in accordance with the invention.

In accordance with a feature of the invention, after the cargo storage container 10 is fully loaded, it may be transported alone by its own propulsion means over the loading land area 44 and into the sea 46. When the device 26 is used for this purpose, it is moved with the cargo storage container 10 out on the sea 46 where it is transferred to a sea-going vessel generally designated 50. The container 10 includes ballasting means 51 in a tank section 53. In accordance with a further feature of the invention, the sea-going vessel 50 includes one or more loading spaces or cargo spaces 52, 54 and 56, etc. which, in the embodiment of FIG. 5, extend from one side of the vessel to the other and are accessible through loading openings 60, 62, 64, etc. The loading openings 60, 62 and 64 are advantageously located so that at least a portion of them may be positioned above or below water level in accordance with which type of loading device is employed. The vessel is advantageously provided with receiving rollers 66 disposed from one side of the opening 60 on the port side, for example, to a side opening 60 on the opposite side or starboard side. The cargo storage container may then be lifted by the lifting structure 34 and positioned on the rollers for easy guiding movement into the loading cargo space.

Figure 6:
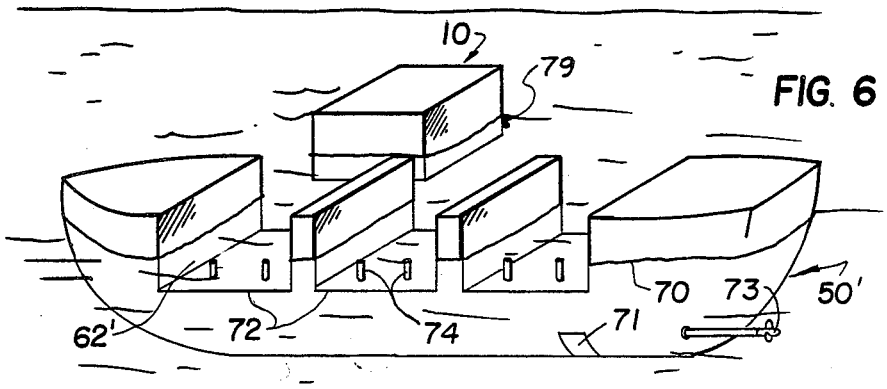
FIG. 6 is a view similar to FIG. 5 of another embodiment of the invention wherein the cargo storage container is self-propelled and is floated into position in the cargo storage space of the vessel.

In the embodiment shown in FIG. 6, the vessel 50' is such that it may be ballasted by ballasting means 71 so that the water line 70 is disposed above a bottom 72 of each loading space. The cargo container 10 may then be floated into the receiving area 62' by its own propulsion means 79. Once the cargo container 10 is in position in the loading space 62', it may be ballasted so that it sinks down into the space or the vessel 50' may be deballasted so that the water level lowers and the cargo container 10 is firmly engaged, for example, by lowering the containers so that holding pins 74 engage into receiving openings (not shown) located on the bottom of each cargo storage container 10. The ship has propulsion means 73.

Figure 4:
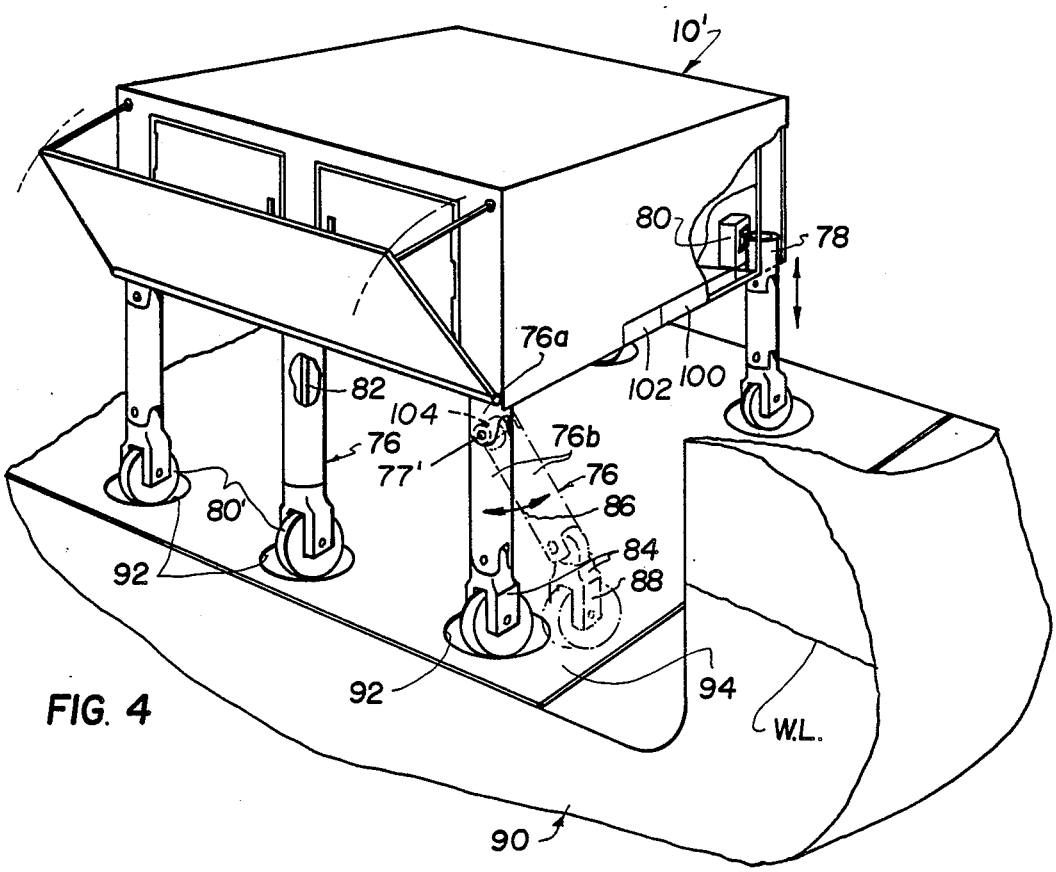
FIG. 4 is a partial top side perspective of a cargo ship indicating a cargo loading container thereon floated into position in a receiving cargo storage space of the vessel.

In the embodiment of FIG. 4, a cargo storage container 10' is shown as including extendable and retractable legs generally designated 76. Each leg 76 fits in a tubular receiving compartment 78 of the cargo storage container 10' and means 80 are provided for raising and lowering the leg in respect to the container 10'. For example, the legs 76 may be extended so that the lower ends which contain either paddle wheels or land wheels 80' may be engaged on dry land or on the surface of the sea. Propulsion means 82 are associated with one or more legs 76 for driving each wheel or each paddle wheel as the case may be. In addition, the propulsion means includes means connected to mounting brackets 84 for each of the wheels or paddle wheels so that they may be tilted in respect to the associated leg 76. The legs 76 also include the lower part **76*b* which is pivotal at 77' in respect to an upper part 76*a* for the purpose of shifting the support for the container 10'. This may be desirable for example when it is desired that the container be supported in a position between two outermost legs 76 on each side thereof which may be shifted outwardly as shown by the arrow 86 into a dotted line position indicated at 88. In such a case, the brackets 84 are shifted so that the wheels extend outwardly and the support may be outwardly from each side of the container 10'**. This may be necessary, for example, to avoid obstacles in the sea water bed including mines, or, for example, it may be desirable to move the container over a land mass by straddling each side of it.

In accordance with another feature, the cargo container 10' may be engaged on a vessel generally designated 90 by inserting the legs 76 into receiving openings 92. The legs 76 are of a length substantially equal to the height of the block-like structure and are extendible from the bottom of the structure by an amount substantially equal to the height of the structure so that they may support the structure on the sea bed. In this way, the legs may comprise guides which facilitate the lowering of the cargo container 10' downwardly into the receiving storage space 94.

The container 10' includes a tank section 100 and ballasting means 102. Drive means 104 are connected to pivot 77' for shifting the pivotal portion **76*b* of the legs relative to the fixed portion 76*a***.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

What is claimed is:

1. A floatable cargo storage container comprises a block-like structure having an interior cargo storage space, at least one side wall having an opening therein through which the cargo may be loaded, means for closing said opening, said cargo storage container including a tank section defining a flotation chamber, means for ballasting and unballasting said flotation chamber for raising and lowering the container structure in the sea, and a plurality of tubular spaces in said storage container defining leg receiving recesses, a leg associated with each receiving space, means for extending and retracting said legs, said legs being of a length substantially equal to the height of said block-like structure and being extendable from the bottom of said structure by an amount substantially equal to the height of said structure so that they may support said structure on the sea bed, and propulsion means associated with said legs for moving the container through water and over land.

2. A cargo storage container according to claim 1, wherein said propulsion means comprises a rotatable wheel member.

3. A cargo storage container according to claim 1, wherein said supporting wheels include a fixed portion and a lower pivotal portion, means for shifting said pivotal portion relative to said fixed portion, and a bracket containing said wheels mounted on said movable portion at the outer end thereof, and means for moving said bracket relative to said outer end of said movable portion.

4. A cargo ship construction comprising a ship having a hull structure with at least one cargo storage space opening to at least one side of said hull structure, both above and below the water line, a cargo warehouse storage container of substantially the size of the cargo storage space and having a large loading space with a front loading opening and a door closing the opening of said loading space, said warehouse storage container being insertable through the opening into said cargo storage space, flotation means associated with said cargo storage container for floating the cargo storage container on the sea to and away from said hull structure, ballasting means carried on said ship for floating said hull structure selectively to a water level above said cargo space opening and below said cargo space opening for facilitating the insertion and removal of said cargo storage container, and propulsion means associated with said cargo warehouse for supporting and moving said cargo warehouse over land for moving it through the sea, said propulsion means comprising a separate cargo storage container support structure comprising said flotation means and having a separate lifting means for lifting the cargo storage container thereon and having ground engaging land wheels and a propulsion unit for propelling it over both land and sea for moving the container from a land area out to the sea to said cargo ship for joining to said hull structure for movement over the sea as part of said cargo ship.

5. A method of transporting goods by sea using a ship and without moving the ship to an unloading dock on land, with a ship having a hull structure with at least one separately floatable warehouse hull portion large enough to form a complete warehouse storage depot which has a side wall with a loading bay which is openable for access by a loading vehicle into the interior for storing a multiplicity of both bulk materials and containerized materials and separate objects, comprising separating the hull portion from the hull structure while the hull structure is at sea and is ballasted so that the warehouse hull portion is low enough in the sea so as to float said warehouse hull portion away from said hull structure, moving the floatable warehouse hull portion over the sea and onto land, unloading the floatable warehouse hull portion while it is on land, and installing a new loaded separately floatable warehouse into the hull structure while the ship remains at sea.

6. A method according to claim 5, wherein the separately floatable warehouse portion is provided with its own means for powering it both on land and sea and including moving the warehouse hull portion by its own powering means both on land and on sea.

7. A method according to claim 5, wherein the separately floatable warehouse portions are loaded over a period of time on land and wherein the ship after it completes a sea voyage is unloaded adjacent a land harbor while still out at sea and reloaded with a full warehouse hull portion.

8. A method according to claim 5, wherein the floatable warehouse hull portion comprises a plurality of said warehouse hull portions making up the hull structure of said ship and forming an integral flotation portion thereof and including securing each floatable warehouse hull portion to the ship so that it forms with said hull structure a unified ship.

9. A method of transporting goods by sea using a ship and without moving the ship to an unlocking dock on land, with a ship having a hull structure with at least one separately floatable warehouse hull portion large enough to form a complete warehouse storage depot which has a side wall with a loading bay which is openable for access by a loading vehicle into the interior for storing a multiplicity of both bulk materials and containerized materials and separate objects, comprising separating the warehouse hull portion from the hull structure while the hull structure is at sea and is ballasted so that the warehouse hull portion is low enough in the sea so as to float said warehouse hull portion away from said hull structure, moving the floatable warehouse hull portion over the sea and onto land, unloading the floatable warehouse hull portion while it is on land, and installing a new loaded separately floatable warehouse hull portion into the hull structure while the ship remains at sea, and wherein the separately floatable warehouse hull portion is engaged by a separate float member having a lifting portion for the warehouse hull portion and which includes means for propelling it over the land.

* * * * *